US006071038A

United States Patent [19]

Strobl, Jr.

[11] Patent Number: 6,071,038

[45] Date of Patent: Jun. 6, 2000

[54] DEVICE FOR HOLDING PAVING BLOCKS IN POSITION

[76] Inventor: Frederick P. Strobl, Jr., 204 N. Shore Dr., Cary, Ill. 60013

[21] Appl. No.: 09/145,712

[22] Filed: Sep. 2, 1998

[51] Int. Cl.[7] ..... E01C 11/22

[52] U.S. Cl. ..... 404/7; 52/102; 47/33

[58] Field of Search ..... 404/6, 7, 8, 99; 47/33; 52/102

[56] References Cited

U.S. PATENT DOCUMENTS

| | | | |
|---|---|---|---|
| 3,916,563 | 11/1975 | Tedesh | 47/33 |
| 4,863,307 | 9/1989 | Jones | 404/7 |
| 4,967,522 | 11/1990 | Keen | 52/102 |
| 4,969,289 | 11/1990 | Trifiletti | 47/33 |
| 4,976,063 | 12/1990 | Young | 47/33 |
| 5,092,076 | 3/1992 | Terreta | 47/33 |
| 5,168,678 | 12/1992 | Scott, Jr. et al. | 52/102 |
| 5,212,917 | 5/1993 | Krutz et al. | 404/7 |
| 5,240,343 | 8/1993 | Strobl, Jr. | 404/7 |
| 5,259,154 | 11/1993 | Lilley | 47/33 |
| 5,375,941 | 12/1994 | Strobl, Jr. | 404/7 |
| 5,377,447 | 1/1995 | Fritch | 47/33 |
| 5,720,128 | 2/1998 | Smith et al. | 47/33 |
| 5,769,562 | 6/1998 | Jones | 404/7 |

*Primary Examiner*—Robert E. Pezzuto
*Assistant Examiner*—Kristine M. Markovich
*Attorney, Agent, or Firm*—Shook, Hardy & Bacon L.L.P.

[57] ABSTRACT

An elongated holding device for holding paving blocks in place. The device has a pair of longitudinally spaced ends, an elongated vertical plate having a front paving block contacting face to define a border for a paved area, and a rear surface. The device also includes a plurality of discrete, elongated footing elements which are attached to a lower portion of the rear surface of the plate. The footing elements are spaced apart longitudinally of the plate and extend rearwardly therefrom. A first connector structure which includes an elongated, longitudinally extending tab is located at one end of the device. The footing elements each including a respective second connector structure in the form of a tab receiving opening. Each of the tab receiving openings is configured to receive and mate with the tab of the first connector element to thereby form a secure connection therebetween. The presence of a connector structure at each footing element increases the overall ability of the device to be adapted to fit the edging requirements and characteristics of paving areas of various sizes and shapes.

39 Claims, 3 Drawing Sheets

DEVICE FOR HOLDING PAVING BLOCKS IN POSITION

BACKGROUND OF THE INVENTION

1. Field of the Invention

This invention relates to elongated holding devices for holding paving blocks in place in paved areas. In particular the invention relates to such devices which are flexible and economical to install and which adapt readily to various shapes of paved areas. Even more particularly the invention relates to a novel connector structure whereby a plurality of the devices may be readily arranged in a longitudinally extending, edge defining array.

2. The Prior Art Background

Paving blocks are commonly used in landscaping to perform both decorative and utilitarian functions. However, natural freezing and thawing cycles of the ground on which blocks are laid, as well as vehicular and pedestrian traffic, cause lateral movement of the blocks. This movement may destroy both the utilitarian and the decorative aspects of the blocks. Thus, it has become established in the art that the blocks should be held in place by restraints which resist horizontal movement of the blocks.

Various edge support arrangements exist to hold paving blocks in place, including the arrangements described in U.S. Pat. Nos. 5,240,343 and 5,375,941, the entireties of the disclosures of which are hereby incorporated by reference. Another known arrangement is illustrated in U.S. Pat. No. RE 33,550.

Typical of the problems faced by installers of paved areas is the fact that a large variety of different shaped edge surfaces may be presented by the paved area. Some edge surfaces will be straight and flat while others may curve horizontally and/or vertically. When either the upper surface or the lateral edges of the paved surface are curved, it is difficult to adjust the holding arrangement to an appropriate shape. Moreover, the length of the edges vary from application to application.

For economy of manufacturing and transportation, edging devices are generally constructed as straight individual pieces having conventional lengths. But the paved areas have shapes and edge lengths which do not necessarily coincide with the configuration of conventional edging devices. So modification and adjustment of the lengths of individual pieces in the field is often required. Moreover, the lengths of edging preferably are connected together in an end-to-end relationship so as to provide a consistent, strong and integrated edge for the paving block arrangement.

The joining of individual pieces together to present a long edge around an area to be paved presents additional problems. Prior art joints inherently present weaknesses in the overall arrangement. Moreover, the joining of the separate pieces is often troublesome, requiring special arrangements and tools.

SUMMARY OF THE INVENTION

The present invention provides an edging device which solves many of the problems which have been endemic in the paving block installation field in the past. In particular the invention provides a holding device which facilitates the interconnection of a plurality of individual pieces so as to provide a strong and secure paving arrangement. Thus, the invention provides an elongated holding device which has a pair of longitudinally spaced ends for holding paving blocks in place.

The device includes an elongated vertical plate having a front paving block contacting face for defining a border for a paved area. The plate also has a rear surface.

The device may also include a plurality of discrete, elongated footing elements that may be attached to the plate. The footing elements preferably are spaced apart longitudinally of the plate and extend rearwardly therefrom. The device further includes a first connector structure located at one end of the device and the footing elements may each include a respective second connector structure. Each of the second connector structures is configured to mate with the first connector element to thereby form a secure connection.

The first connector structure comprises an elongated tab and each of the second connector structures defines a tab receiving opening. The elongated tab preferably extends longitudinally of the device. The footing elements each preferably includes a nail boss. The nail bosses preferably are spaced rearwardly from the vertical plate.

The footing elements of the device may each include a lower ground contacting surface that is spaced from the rear surface of the plate, and the device preferably includes an elongated strip member which extends therealong for interconnecting the footing elements. In a highly preferred form of the invention, the device may present a number of longitudinally spaced open areas, each defined by the vertical plate, the footing elements and the strip member.

The footing elements are preferably attached to a lower portion of the rear surface of the plate and may each include a first portion presenting a lower ground contacting surface which is spaced from the rear surface of the plate. The footing elements of the device in accordance with the invention each preferably may also include a second portion having a lower ground contacting surface which is located adjacent the rear surface of the plate. The tab receiving opening is preferably located between the first and second portions of the footing element. The footing elements may also include a third portion which interconnects the first and second portions and is disposed above the opening.

The tab and the third portions may each include a vertical stake receiving aperture, which apertures are positioned so that the aperture of the tab is disposed in vertical alignment with the aperture of the third portion of a selected footing element when the tab is received in the opening of the selected footing element. The device may also include respective cylindrical nail bosses located on the third portions of the footing structures. The bosses preferably present a vertical opening disposed in alignment with the aperture of the third portion on which it is located.

In accordance with the invention, the footing elements of the holding device may each include a first ground contacting portion presenting a first lower ground contacting surface which is spaced from said rear surface of the plate, an elevated portion which does not contact the ground and which is located between said ground contacting portion and said plate and a second ground contacting portion presenting a second lower ground contacting surface that is located between the elevated portion and the plate. The tab receiving opening is preferably defined by the portions of the footing elements.

In accordance with a further embodiment of the invention, the first connector structure may include a pair of locking protrusions which extend outwardly from said one end of the device on opposite sides of the tab. Such protrusions may respectively be positioned so as to overlap a respective locking area on an upper surface of each of said ground contacting portions.

The device may also include a bump on each of said locking areas and an indentation on each of said protrusions, said bumps and said protrusions being located so as to mate and interlock when the tab is inserted into a respective tab receiving opening for locking the tab in place in the opening. Alternatively, the device may include an indentation in each of said locking areas and a bump on each of said protrusions, said bumps and said protrusions being located so as to mate and interlock when the tab is inserted into a respective tab receiving opening for locking the tab in place in the opening.

The device of the invention may include at least one bump on a lower surface of the elevated portion overlying said opening and at least one indentation in said tab, said bump and said indentation being located so as to mate and interlock when the tab is inserted into a respective tab receiving opening for locking the tab in place in the opening. Alternatively, the device of the invention may include at least one indentation in a lower surface of the elevated portion overlying said opening and at least one bump on said tab, said bump and said indentation being located so as to mate and interlock when the tab is inserted into a respective tab receiving opening for locking the tab in place in the opening.

DETAILED DESCRIPTION OF THE PREFERRED EMBODIMENTS

Figure 1:
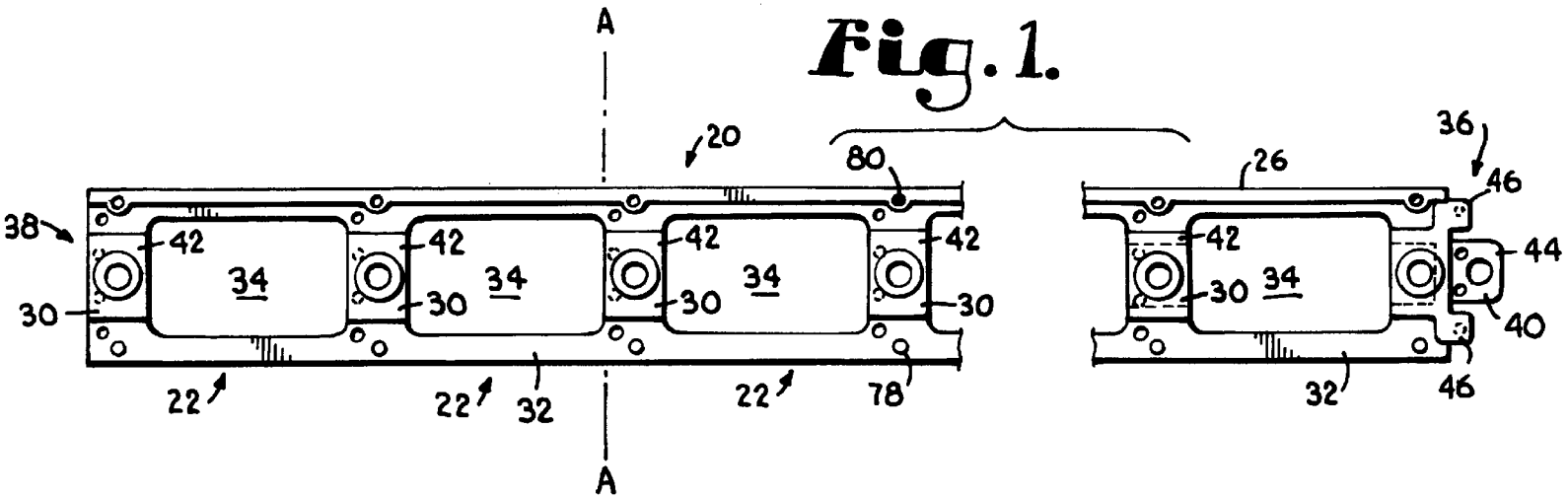
FIG. 1 is top plan view of a device for holding paving blocks in place which embodies the principles and concepts of the invention.

An elongated holding device which embodies the principles and concepts of the invention is illustrated in FIG. 1 and is identified therein by the reference numeral 20. As can be seen, the device includes a number of repeating units 22. FIG. 1 is a partial top plan view of the device with a number of the repeating units broken away for convenience of illustration. In actuality, however, the device 20 may preferably have a length of 8 feet or more and may include 23 or even more of the repeating units 22. For purposes of the invention, however, neither the length of the device nor the number of repeating units is critical, and the length and number of repeating units will often be determined by practical considerations for purposes such as shipping, handling and storage.

The device 20 includes an elongated vertical plate 24 which is essentially coextensive in length with the device 20. The plate 24 provides a front paving block contacting face 26 which defines a border for a paved area. The plate also has a rear surface 28.

The device 20 also includes a plurality of discrete footing elements 30 which are attached to plate 26. As can be seen in FIG. 1, the footing elements 30 are spaced apart longitudinally of the plate 24 and extend rearwardly therefrom. The device 20 may also include an elongated strip member 32 which is essentially coextensive in length with the device and extends therealong to interconnect the footing elements 30. And as can particularly be seen in FIG. 1, the device 20 thus presents a plurality of longitudinally spaced open areas 34 which are defined by the plate 24, the footing elements 30 and the elongated strip 32.

Because it is elongated, the device 20 has a pair of spaced ends 36 and 38. A first connector structure 40 is provided at end 36. Each of the footing elements 30, including the footing element 30 and end 38 of the device, includes a respective second connector structure 42. And for purposes of the present description, these second connector structures 42 are all essentially the same.

Figure 4:
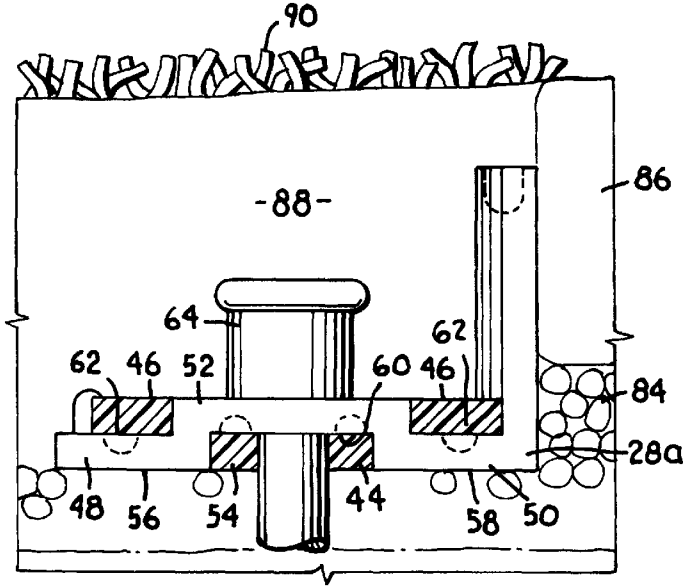
FIG. 4 is an enlarged, partial cross-sectional view taken essentially along the line 4—4 of FIG. 3.
Figure 3:
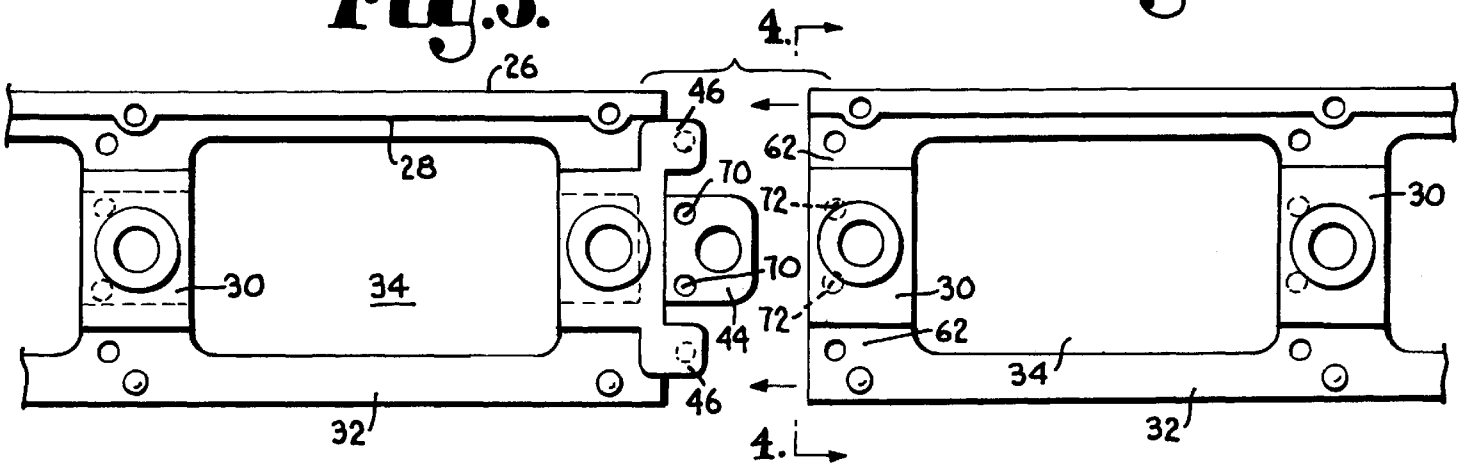
FIG. 3 is a top plan view of the devices of FIG. 2.
Figure 2:
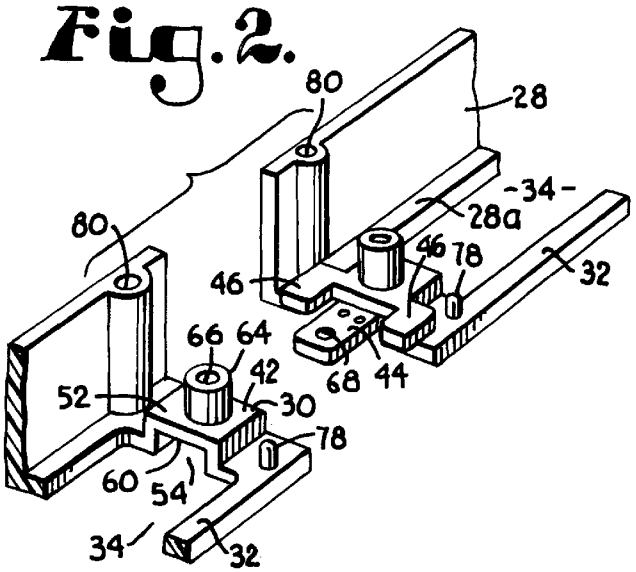
FIG. 2 is an isometric view showing the ends of two adjacent devices which are about to be interconnected in accordance with the invention.
Figure 5:
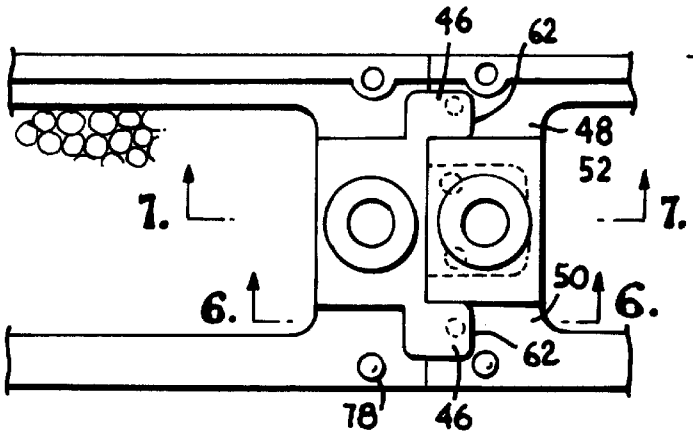
FIG. 5 is a top plan view showing the devices of FIG. 3 after the same have been joined in accordance with the invention.
Figure 6:
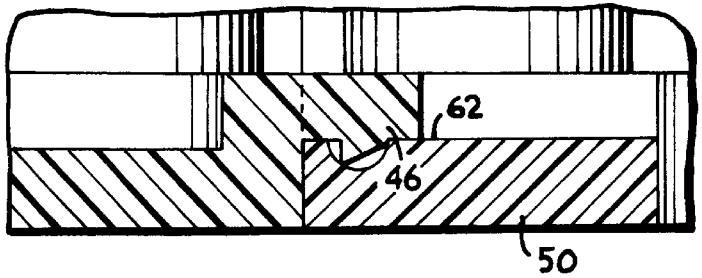
FIG. 6 is an enlarged, partial cross-sectional view taken essentially along the line 6—6 of FIG 5.
Figure 7:
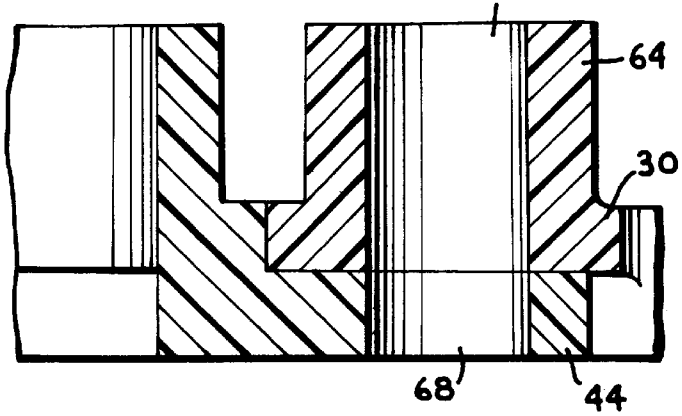
FIG. 7 is an enlarged, partial cross-sectional view taken essentially along the line 7—7 of FIG. 5.

In accordance with the invention, and as can be seen viewing FIGS. 2–7, a plurality of the devices of the invention may be interconnected in end-to-end relationship to provide an arrangement of devices which in use defines the edges of an area to be paved. The second connector structures 42 are each configured to mate individually with the first connector structure 40 so as to form a secure connection between adjacent devices. This secure connection is illustrated in FIGS. 5–7.

The first connector structure 40 may comprise a tab 44 which extends longitudinally of the device 20. The first connector structure 40 also may include a pair of locking protrusions 46 which likewise extend outwardly from device 20 and longitudinally thereof an opposite sides of the tab 44 as shown. With reference to FIG. 4, it can be seen that the protrusions 46 are higher in elevation than the tab 44.

As mentioned previously, each of the footing elements 30 include a second connector structure 42. The purpose of such a configuration will be discussed hereinafter. Each footing element 30 is attached to a lower portion 28*a* of the rear surface 28 of the plate 24. Each footing element 30 may include a first portion 48 which is spaced from the vertical plate 24, a second portion 50 which is adjacent plate 24 and an elevated third portion 52 which is located between and interconnects portions 48 and 50 as can particularly be seen in FIG. 4. Thus, the portions 48, 50 and 52 define a tab receiving opening 54 that is located between portions 48 and 50. Thus, when two adjacent devices are assembled, as illustrated in FIGS. 4–7, the tab 44 is snugly received in the opening 54.

The portion 48 has a lower ground contacting surface 56 which is spaced from the rear surface 28 of plate 24. Likewise, the portion 50 of the footing element 30 has a lower ground contacting surface 58 which is adjacent the rear surface 28 of the plate 24. The elevated third portion 52 of the footing element 30 has a lower surface 60 which is disposed above the opening 54.

Each of the portions 48 and 50 of the footing elements 30 provides an upper locking area 62, said areas 62 being disposed on respective opposite sides of the elevated portion 52. And as can be seen in FIG. 5, when two adjacent devices are assembled in end-to-end relationship, the protrusions 46 overlap the locking areas 62.

Each of the footing elements 30 also includes a nail boss 64 mounted atop the elevated portion 52. The boss 64 is spaced rearwardly from plate 24. A generally vertical stake receiving aperture 66 extends downwardly through the nail boss 64 and the elevated portion 52. A corresponding stake receiving aperture 68 is provided in the tab 44 so that when the adjacent devices are assembled in end-to-end relationship, as shown in FIGS. 4–7, the apertures 66 and 68 are in substantial vertical alignment.

In a preferred embodiment, a pair of bumps 70 are provided on the upper surface of tab 44 and a pair of corresponding indentations 72 are provided in the lower surface 60 of portion 30. Thus, when the adjacent pieces are assembled, the bumps 70 may snap into the indentations 72 to thereby provide a secure connection. Similarly, bumps 74 are provided on the upper surfaces of protrusions 46 and corresponding indentations 76 are provided in the locking areas 62. Once again, the bumps 74 may snap into the indentations 76 when two adjacent pieces are assembled to provide a secure connection.

As would be readily appreciated by one of ordinary skill in the art, the positions of the bumps and indentations could be reversed.

Figure 8:
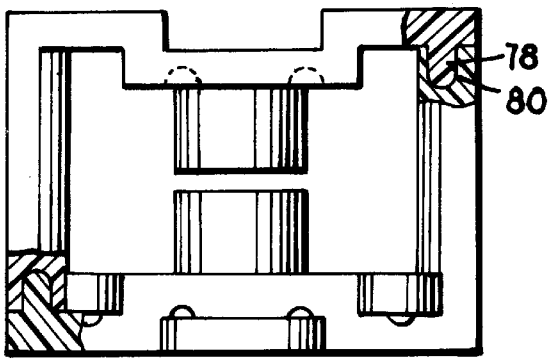
FIG. 8 is an end view showing two of the devices of the invention in a stacked condition.

With reference to FIG. 8, the device may be provided with stacking pegs 78 and corresponding stacking holes 80. These pegs and holes facilitate stacking of the devices are illustrated in FIG. 8 for shipping and handling purposes.

The arrangement of the devices in an operational mode as illustrated in FIG. 4. In this regard, it is to be noted that the interconnected devices may generally be placed on a base course 82 made of compacted gravel or the like. The ground contacting portions 48 and 50 of the device are in contact with the base course. Conventionally a layer of sand 84 may be placed on top of the base course 82 in those areas which are to be paved with the paving blocks 86. The paving blocks 86 at the edges of the paved area are generally disposed in contact with the paving block contacting face 26 of a device 20.

To complete the installation, the space behind the rear surface 28 of the device 20 may be backfilled with dirt 88 and grass 90 may be grown on top of the backfilled area. The longitudinally spaced openings 34 provide access for the growth of grass roots which solidify and strengthen the installation as is fully explained in the '343 and '941 patents identified above.

As discussed previously, the footing elements 30 include connector structures 42 which are essentially alike. This construction facilitates the assembly of the devices when an entire length of the device 20 is not needed. Thus, the device 20 may be cut adjacent a footing element 30 at an intermediate position such as at the line A—A in FIG. 1, and attachment to an adjacent device is still possible because of the initial presence of a connector structure 42 at each footing element 30. This arrangement thus provides maximum flexibility, particularly when coupled with the snip and cut features provided by the apertures 34 and the strip 32, as is explained in greater detail in the '343 and '941 patents identified above and which have been incorporated by reference.

Figure 9:
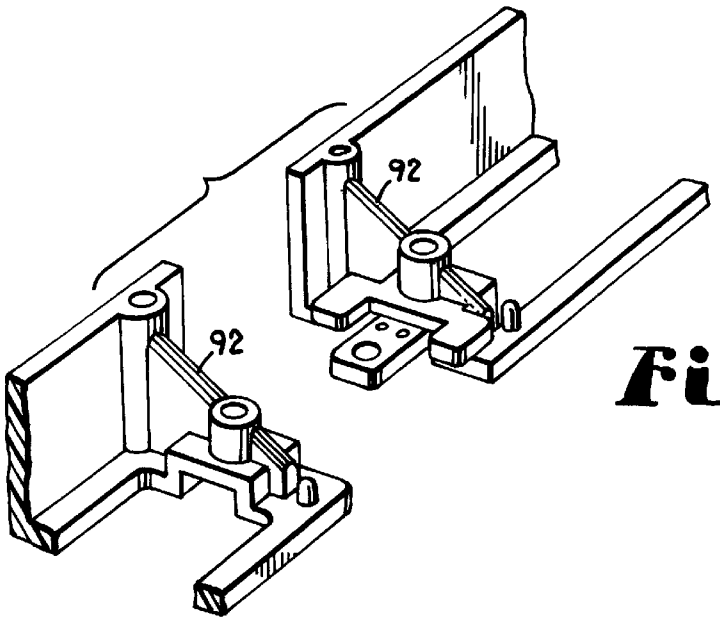
FIG. 9 is an isometric view similar to FIG. 2 but showing an alternative embodiment of the invention.

With reference to FIG. 9, an alternative embodiment of the device is illustrated. Thus, the device may be provided with the support plate 92 for additional rigidity. In this regard it should be noted that the only essential difference between the device of FIGS. 1–8 and the device of FIG. 9 is the inclusion of the plate 92 as illustrated.

In its preferred form, the device of the invention may be molded in pieces approximately 8 feet long and with the repeating units situated on approximately 4 inch centers. Although any moldable plastic material may be utilized, the device may preferably be molded from a low grade recycled polyethylene for reasons of economy. The polyethylene may be blown with a gas to improve its overall characteristics and moldability. The plate 24 may preferably be approximately 1.9 inches high and the footing structures may provide an overall width of approximately 3 inches. All thicknesses may preferably be approximately 0.215 inches, particularly to facilitate molding. These dimensions, however, are in no way critical to the application of the invention.

I claim:

1. An elongated device for holding paving blocks in place in a paved area, said device comprising:

an elongated plate having an upright front paving block contacting face and a rear surface;

a plurality of discrete, elongated footing elements attached to said plate, said footing elements being spaced apart longitudinally of said plate, said footing elements each extending rearwardly from said rear surface; and a first connector structure located at one end of the plate, said footing elements each including a respective second connector structure, said second structures each being configured to mate with said first connector structure to thereby form a secure connection therebetween.

2. A holding device as set forth in claim 1, wherein said first connector structure comprises an elongated tab and said second connector structures each define a tab receiving opening.

3. A holding device as set forth in claim 2, wherein said tab extends longitudinally of said device.

4. A holding device as set forth in claim 1, wherein each of said footing elements includes a nail boss.

5. A holding device as set forth in claim 4, wherein said nail bosses are spaced rearwardly from said plate.

6. A holding device as set forth in claim 1, wherein said footing elements each include a lower ground contacting surface which is spaced from said rear surface of the plate.

7. A holding device as set forth in claim 1, wherein said device includes an elongated strip member which extends therealong in interconnecting relationship to said footing elements.

8. A holding device as set forth in claim 7, wherein said device presents a number of longitudinally spaced open areas defined by said plate, said footing elements and said strip member.

9. A holding device as set forth in claim 1, wherein said footing elements are attached to a lower portion of said rear surface of the plate.

10. A holding device as set forth in claim 9, wherein said footing elements each include a lower ground contacting surface which is spaced from said rear surface of the plate.

11. A holding device as set forth in claim 2, wherein said footing elements are attached to a lower portion of said rear surface of the plate.

12. A holding device as set forth in claim 11, wherein said footing elements each include a first portion having a lower ground contacting surface which is spaced from said rear surface of the plate.

13. A holding device as set forth in claim 12, wherein said footing elements each include a second portion having a lower ground contacting surface which is located adjacent said rear surface of the plate, said opening being located between said first and second portions.

14. A holding device as set forth in claim 13, wherein said footing elements each include an elevated third portion which interconnects said first and second portions and is disposed above said opening.

15. A holding device as set forth in claim 14, wherein said tab and said third portions each include a vertical stake receiving aperture, said apertures being positioned so that the aperture of the tab is disposed in vertical alignment with the aperture of the third portion of a selected footing element when the tab is received in the opening of said selected footing element.

16. A holding device as set forth in claim 15, wherein said footing element each include a cylindrical nail boss located on said third portion thereof and having a vertical opening disposed alignment with the aperture of the third portion on which it is located.

17. A holding device as set forth in claim 2, wherein said footing elements each include a ground contacting portion having a lower ground contacting surface which is spaced from said rear surface of the plate.

18. A holding device as set forth in claim 17, wherein said footing elements each include an elevated portion which does not contact the ground and which is located between said ground contacting portion and said plate.

19. A holding device as set forth in claim 17, wherein said footing elements each include a second ground contacting portion having a second lower ground contacting surface thereon, said second ground contacting portion being located between said elevated portion and said plate.

20. A holding device as set forth in claim 19, wherein said portions are arranged so as to define said opening.

21. An elongated holding device for holding paving blocks in place, said device having a pair of longitudinally spaced ends, said device comprising:

an elongated vertical plate having a front paving block contacting face to define a border for a paved area, said plate having a rear surface;

plurality of discrete, elongated footing elements attached to said plate, said footing elements being spaced apart longitudinally of said plate and extending rearwardly therefrom; and a first connector structure located at one end of the device, said footing elements each including a respective second connector structure, said second structures each being configured to mate with said first connector structure to thereby form a secure connection therebetween, said first connector structure comprising an elongated tab and said second connector structures each defining a tab receiving opening, said footing elements each including a first ground contacting portion having a first lower ground contacting surface which is spaced from said rear surface of the plate, an elevated portion which does not contact the ground and which is located between said first ground contacting portion and said plate, and a second ground contacting portion having a second lower ground contacting surface thereon, said second ground contacting portion being located between said elevated portion and said plate, said portions being arranged so as to define said opening, said first connector structure including a pair of locking protrusions which extend outwardly from said one end of the device of the opposite sides of the tab, said protrusions being respectively positioned so as to overlap a respective locking area on an upper surface of said ground contacting portions.

22. A holding device as set forth in claim 21, wherein said device includes a bump on each of said locking areas and an indentation on each of said protrusions, said bumps and said indentations being located so as to mate when the tab is inserted into a respective tab receiving opening for locking the tab in place in the opening.

23. A holding device as set forth in claim 21, wherein said device includes an indentation in each of said locking areas and a bump on each of said protrusions, said bumps and said indentations being located so as to mate when the tab is inserted into a respective tab receiving opening for locking the tab in place in the opening.

24. A holding device as set forth in claim 20, wherein is included a lower surface on said elevated portion overlying said opening, said device including at least one bump on said lower surface and at least one indentation in said tab, said at lest one bump and said at least one indentation being located so as to mate when the tab is inserted into a respective tab receiving opening for locking the tab in place in the opening.

25. A holding device as set forth in claim 20, wherein is included a lower surface on said elevated portion overlying said opening, said device including at least one indentation in said lower surface and at least one bump on said tab, said at least one bump and said at least one indentation being located so as to mate when the tab is inserted into a respective tab receiving opening for locking the tab in place in the opening.

26. An elongated holding device for holding paving blocks in place, said device having a pair of longitudinally spaced ends, said device comprising:

an elongated vertical plate having a front paving block contacting face to define a border for a paved area, said plate having a rear surface;

a plurality of discrete, elongated footing elements attached to said plate, said footing elements being spaced apart longitudinally of said plate and extending rearwardly therefrom; and a first connector structure comprising an elongated tab located at one end of the device, said tab extending longitudinally of said device; and a second connector structure located at the other end of the device, said second connector structure comprising a tab receiving opening configured to mate with said tab to thereby form a secure connection therebetween, said first connector structure further including at least one locking protrusion which extends outwardly from said one end of the device at a different elevation and at a different lateral distance from said rear surface than said tab, said at least one protrusion being positioned so as to overlap a locking area on an upper surface of said second connector structure.

27. A holding device as set forth in claim 26, wherein said first connector structure includes two of said protrusions located opposite sides of said tab, there being a respective locking area for each of said protrusions on said upper surface.

28. A holding device as set forth in claim 27, wherein said device includes a bump on each of said locking areas and an indentation on each of said protrusions, said bumps and said indentations being located so as to mate when the tab is inserted into the tab receiving opening for locking the tab in place in the opening.

29. A holding device as set forth in claim 27, wherein said device includes an indentation in each of said locking areas and a bump on each of said protrusions, said bumps and said indentations being located so as to mate when the tab is inserted into a respective tab receiving opening for locking the tab in place in the opening.

30. A holding device as set forth in claim 26, wherein said first connector structure includes a lower surface overlying said opening, said device including at least one bump on said lower surface and at least one indentation in said tab, said at least one bump and said at least one protrusion being located so as to mate when the tab is inserted into a respective tab receiving opening for locking the tab in place in the opening.

31. A holding device as set forth in claim 26, wherein said first connector structure includes a lower surface overlying said opening, said device including at least one indentation in said lower surface and at least one bump on said tab, said at least one bump and said at least one protrusion being located so as to mate when the tab is inserted into a respective tab receiving opening for locking the tab in place in the opening.

32. A holding device as set forth in claim 26, wherein said second connector structure includes a first portion having a lower ground contacting surface which is spaced from said rear surface of the plate and a second portion having a lower ground contacting surface which is located adjacent said rear surface of the plate, said opening being located between said first and second portions.

33. A holding device as set forth in claim 32, wherein said second connector structure includes an elevated third portion which interconnects said first and second portions and is disposed above said opening.

34. A holding device as set forth in claim 33, wherein said tab and said third portion each include a vertical stake receiving aperture, said apertures being positioned so that the aperture of the tab is disposed in vertical alignment with the aperture of the third portion when the tab is received in the opening.

35. A holding device as set forth in claim 34, wherein said second connector structure includes a cylindrical nail boss located on said third portion thereof, said nail boss having a vertical opening disposed in alignment with the aperture of the third portion.

36. A holding device as set forth in claim 26, wherein said second connector structure includes a ground contacting portion having a lower ground contacting surface which is spaced from said rear surface of the plate, an elevated portion which does not contact the ground and which is located between said ground contacting portion and said plate, and a second ground contacting portion having a second lower ground contacting surface thereon, said second ground contacting portion being located between said elevated portion and said plate, said portions being arranged so as to define said opening.

37. An elongated holding device for holding paving blocks in place in a paved area, said device comprising:

an elongated plate having an upright front paving block contacting face and a rear surface;

a plurality of discrete, elongated footing elements attached to said plate, said footing elements being spaced apart longitudinally of said plate, said footing elements each extending rearwardly from said rear surface, said footing elements each including a first ground contacting portion having a first lower ground contacting surface which is spaced from said rear surface of the plate, an elevated portion which does not contact the ground and which is located between said first ground contacting portion and said plate, and a second ground contacting portion having a second lower ground contacting surface, said second ground contacting portion being located between said elevated portion and said plate, said portions being arranged so as to define an opening at ground level where the respective footing elements do not touch the ground.

38. An elongated device for holding paving blocks in position in a paved area, said device comprising:

an elongated plate having an upright front paving block contacting face and a rear surface, said plate having first and second longitudinally spaced ends;

a first connector structure attached to said plate at said first end thereof;

a first elongated footing element attached to said plate at said second end thereof;

a second elongated footing element attached to said plate at a position thereon which is positioned therebetween said first and second ends and in spaced relationship to each, said first and second footing elements each being positioned to extend rearwardly from said rear surface of the plate, said first and second footing elements each including a respective second connector structure, said second connector structures each being configured to mate with said first connector structure to thereby form a secure connection therebetween.

39. A device as set forth in claim 38 which comprises a plurality of said second elongated footing elements.

* * * * *